US006406141B2

(12) United States Patent
Yosimura et al.

(10) Patent No.: US 6,406,141 B2
(45) Date of Patent: Jun. 18, 2002

(54) INK DRIER AND INK JET TYPE IMAGE FORMING APPARATUS MOUNTING THE SAME

(75) Inventors: Hisasi Yosimura, Nara; Kazuya Koyama, Ikoma; Masanori Yamada, Nara; Yuhi Akagawa, Kyoto, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/784,027

(22) Filed: Feb. 16, 2001

(30) Foreign Application Priority Data

Feb. 17, 2000 (JP) ..... 2000-039382
Dec. 15, 2000 (JP) ..... 2000-381442

(51) Int. Cl.[7] ..... B41J 2/01
(52) U.S. Cl. ..... 347/102
(58) Field of Search ..... 347/102, 101, 347/104, 105, 106, 107, 43, 4

(56) References Cited

U.S. PATENT DOCUMENTS 4,774,523 A 9/1988 Beaufort et al.

*Primary Examiner*—Raquel Yvette Gordon

(57) ABSTRACT

In an ink drying portion, a conveying roller and a rigid roller are rotated by driving force of a driving roller which is transmitted through a driving belt. Air in a housing is discharged by means of a fan and air is sucked into the housing through a clearance between the conveying rollers. A paper conveyed into the ink drying portion is continuously held along a paper drying passageway by the air sucking effect of the discharge of the fan and is consecutively conveyed along the paper drying passageway through the conveying roller. An ink on the paper is dried by direct irradiation with infrared rays from an infrared heat source or by indirect irradiation with infrared rays reflected by a reflecting plate.

17 Claims, 9 Drawing Sheets

INK DRIER AND INK JET TYPE IMAGE FORMING APPARATUS MOUNTING THE SAME

BACKGROUND OF THE INVENTION

1. Field of the Invention

The present invention relates to an ink drier for drying an ink on a paper after image formation and an ink jet type image forming apparatus mounting the ink drier, and more particularly, to an ink drier comprising a semicylindrical paper drying passageway for upward inverting a paper conveyed immediately after printing and a heat source provided on the central side of a circular arc of the semicylindrical paper drying passageway, and an ink jet type image forming apparatus mounting the ink drier.

2. Description of the Prior Art

In an ink jet type image forming apparatus, a time required for drying an ink after image formation considerably influences an efficiency of a whole printing process. In particular, a pigment based black ink capable of easily obtaining high picture quality generally requires a long time for drying. Therefore, in the case of an image having a high area ratio of a black dot such as a black solid, a long time is required for drying the ink, thereby deteriorating an increase in the speed of a printing operation. On the other hand, if the speed of the printing operation is increased carelessly, a conveying roller comes in contact with a print surface of a paper or the paper is mounted on a discharge tray in such a state that the ink is dried:incompletely, for example. Consequently, there is a drawback that the print surface or back face of the paper is stained with the ink.

For example, Japanese Patent Application Laid-Open Sho 63 No.252772 has proposed an ink jet type printer mounting an ink drier for drying a paper immediately after printing.

As shown in FIG. 1, a printer Z0 proposed in the above-mentioned publication comprises a paper tray 51 for storing a print paper, a pinch roller 52 for conveying the paper in the paper tray 51 one by one, an ink jet type print head 53 for forming an image on the paper conveyed by the pinch roller 52, a semicylindrical paper drying passageway 54 for upward inverting the paper on which an image is formed by the print head 53, an infrared heat source 55 provided in the vicinity of the center of a circular arc of the paper drying passageway 54, a reflecting plate 56 provided on the rear face side of the infrared heat source 55 with respect to the paper drying passageway 54, a discharge roller 57 for discharging the paper conveyed along the paper drying passageway 54, and a discharge tray 58 for accumulating the paper discharged through the discharge roller 57.

A series of printing processes in the printer Z0 will be briefly described below. First of all, one uppermost paper mounted in the paper tray 51 is taken out and is conveyed at a constant speed below the print head 53 through the pinch roller 52. In that case, the print head 53 forms an image on the paper while carrying out a scan in a direction orthogonal to a paper conveying direction. The paper sequentially enters the paper drying passageway 54 from a portion where an image is formed by the print head 53, and is conveyed along the semicylindrical paper dying passageway 54. At this time, an ink on the paper is dried with infrared rays directly irradiated from the infrared heat source 55 or infrared rays reflected by the reflecting plate 56 and indirectly irradiated. The paper having the ink dried which is conveyed along the paper drying passageway 54 is discharged onto the discharge tray 58 through the discharge roller 57.

The printer Z0 mounts an ink drier comprising the semicylindrical paper drying passageway 54, the heat source 55, the reflecting plate 56 and the like. Therefore, a black solid image formed by a lazy drying black ink can also be dried in a short time, for example. Thus, it is possible to increase the speed of a printing operation while maintaining high picture quality. Moreover, the paper is inverted upward and discharged along the semicylindrical paper drying passageway 54. Consequently, there are also advantages that the size of the device can be reduced and the paper can be mounted in correct order.

In the conventional printer Z0, however, only the pinch roller 52 and the discharge roller 57 are provided on the upstream and downstream sides of the paper drying passageway 54 as conveying means for conveying the paper along the paper drying passageway 54. Accordingly, the paper basically conforms to an internal surface with only the rigidity of the paper itself over the paper drying passageway 54. In the case of a paper having a small rigidity such as a thin sheet or a paper in a high humid state, accordingly, a tip thereof droops down by self weight during conveying over the paper drying passageway 54. Consequently, there is a fear that a paper jam might be caused and the paper might come in contact with the heat source 55, thereby catching fire in the worst case.

With the above-mentioned structure, furthermore, a paper having a smaller size than a path length between the pinch roller 52 and the discharge roller 57 cannot be used.

If such a paper is used by mistake, there is a fear that the paper jam might be caused or the paper might come in contact with the heat source 55, thereby catching fire in the same manner as in the case in which the paper having a small rigidity is used.

Moreover, the heat source is provided in the vicinity of the center of the circular arc of the semicylindrical paper conveying passageway. Therefore, heat is uniformly irradiated over the whole paper conveying passageway so that a constant time or more is required for drying an ink. For this reason, there is also a problem in that a drying path length is determined by the drying time and the size of the apparatus cannot be reduced.

SUMMARY OF THE INVENTION

In consideration of the above-mentioned circumstances, it is an object of the present invention to provide an ink drier capable of normally and safely drying an ink on a paper having a small rigidity or a paper having a small size without disadvantages such as a paper jam or an ignition caused by a contact with a heat source, and an ink jet type image forming apparatus mounting the ink drier.

In order to achieve the above-mentioned object, the present invention has the following aspects.

A first aspect of the present invention is directed to an ink drier comprising a semicylindrical paper drying passageway for upward inverting a paper conveyed immediately after printing, a heat source provided on a central side of a circular arc of the paper drying passageway, and paper holding means for continuously holding the paper along the paper drying passageway.

A second aspect of the present invention is directed to the ink drier according to the first aspect, wherein more heat energy sent from the heat source is irradiated onto a paper input side of the paper drying passageway than a paper output side thereof.

A third aspect of the present invention is directed to the ink drier according to the second aspect, wherein the heat source is provided closer to the paper input side than the center of the circular arc of the paper drying passageway.

A fourth aspect of the present invention is directed to the ink drier according to the second aspect, further comprising a reflecting plate provided on a rear face side of the heat source with respect to the paper drying passageway and serving to reflect more heat energy which is not used for paper drying but is dissipated toward the paper input side of the paper drying passageway than the paper output side thereof.

A fifth aspect of the present invention is directed to the ink drier according to the third aspect, further comprising a reflecting plate provided on a rear face side of the heat source with respect to the paper drying passageway and serving to reflect more heat energy which is not used for paper drying but is dissipated toward the paper input side of the paper drying passageway than the paper output side thereof.

A sixth aspect of the present invention is directed to the ink drier according to the first aspect, wherein the paper holding means utilizes air suction.

A seventh aspect of the present invention is directed to the ink drier according to the first aspect, wherein the paper holding means utilizes electrostatic attraction.

An eighth aspect of the present invention is directed to the ink drier according to the first aspect, further comprising paper conveying means for continuously conveying the paper along the paper drying passageway.

A ninth aspect of the present invention is directed to the ink drier according to the eighth aspect, wherein the paper conveying means is constituted by a plurality of rollers provided along the paper drying passageway.

A tenth aspect of the present invention is directed to the ink drier according to the ninth aspect, wherein the rollers are interlocked through one endless belt.

An eleventh aspect of the present invention is directed to the ink drier according to the eighth aspect, wherein the paper conveying means is constituted by a belt provided along the paper drying passageway.

A twelfth aspect of the present invention is directed to the ink drier according to the eleventh aspect, wherein the belt as the paper conveying means is guided by a guide member provided along edge portions on both sides of the paper drying passageway.

A thirteenth aspect of the present invention is directed to the ink drier according to the first aspect, wherein curl correcting means for correcting a curl of the paper is provided on a downstream side of the paper drying passageway.

A fourteenth aspect of the present invention is directed to the ink drier according to the thirteenth aspect, wherein the curl correcting means is constituted by rollers having different hardnesses which come in pressure-contact with each other.

A fifteenth aspect of the present invention is directed to the ink drier according to the fourteenth aspect, wherein the rollers having different hardnesses are constituted by elastic roller and rigid roller.

A sixteenth aspect of the present invention is directed to the ink drier according to the thirteenth aspect, wherein the curl correcting means is constituted by rollers having different diameters which come in pressure-contact with each other.

A seventeenth aspect of the present invention is directed to an ink jet type image forming apparatus mounting an ink drier comprising a semicylindrical paper drying passageway for upward inverting a paper conveyed immediately after printing, a heat source provided on a central side of a circular arc of the paper drying passageway, and paper holding means for continuously holding the paper along the paper drying passageway.

According to the present invention having the above-mentioned structure, when the paper is to be conveyed along the paper drying passageway immediately after printing, the paper is continuously held along the paper conveying passageway. Therefore, even in the case in which a paper having a small rigidity such as a thin sheet or a paper in a high humid state is used, for example, the tip of the paper does not droop down by self weight. Thus, it is possible to reliably prevent the drawback such as a paper jam or an ignition caused by a contact with a heat source.

If the paper holding means utilizes the air suction or the electrostatic attraction, for example, the paper can be held reliably with a simple mechanism.

The ink drier having the above-mentioned structure can be constituted such that more heat energy sent from the heat source is irradiated onto the paper input side of the paper drying passageway than the paper output side. Consequently, the heat source may be provided closer to the paper input side than the center of the circular arc of the paper drying passageway, or there may be disposed with a reflecting plate provided on the rear face side of the heat source with respect to the paper drying passageway and serving to reflect more heat energy which is not used for paper drying but is dissipated on the paper input side of the paper drying passageway than the paper output side thereof. The reflecting plate may adjust the direction of reflection of the heat energy depending on its angle and shape.

According to the above-mentioned structure, more heat energy is irradiated onto the paper input side of the paper drying passageway than the paper output side thereof. Therefore, a time required for drying can be shortened so that a paper conveying path length can be reduced and a small-sized structure can be obtained.

It is also possible to add, to the above-mentioned structure, the paper conveying means for continuously conveying the paper along the semicylindrical paper drying passageway. With such a structure, the paper is continuously conveyed along the paper drying passageway. Consequently, even in the case in which a paper having a smaller length than the path length of the paper drying passageway is used, for example, the paper can be conveyed reliably along the paper drying passageway without a stoppage during the conveying.

It can be proposed that the paper conveying means is constituted by a plurality of rollers provided along the paper drying passageway, for example. In this case, the rollers can be interlocked by one endless belt, for example.

Alternatively, the paper conveying means can also be constituted by a belt provided along the paper drying passageway. With such a structure, there also are advantages in that the mechanism can be more simplified and the air suction, the electrostatic attraction and other paper holding means can also be incorporated as well comparatively easily and the degree of freedom of the paper holding means can be increased.

The belt as the paper conveying means may be guided semicylindrically by the guide member provided along the edge portions on both sides of the paper drying passageway, for example.

Furthermore, if the curl correcting means for correcting the curl of the paper is provided on the downstream side of the paper drying passageway, the paper is discharged in such a state that an inward curl generated by the passage through the paper drying passageway is corrected. Therefore, it is possible to obtain more excellent results of printing.

If the curl correcting means is constituted by the rollers having different hardnesses for example, the elastic roller and the rigid roller, which come in pressure-contact with each other, reliable correction can be achieved with a simple structure. Moreover, even if the curl correcting means is constituted by the rollers having different diameters which come in pressure-contact with each other, the same effects can be obtained.

The ink drier having the above-mentioned structure can be incorporated in an ink jet type image forming apparatus such as a printer or a facsimile, and furthermore, may be a separate device which can be provided externally.

DESCRIPTION OF THE PREFERRED EMBODIMENTS

Embodiments and examples according to the present invention will be described below with reference to the accompanying drawings. The following embodiments and examples specify the present invention and do not restrict the technical scope of the present invention.

<First Embodiment>

Figure 1:
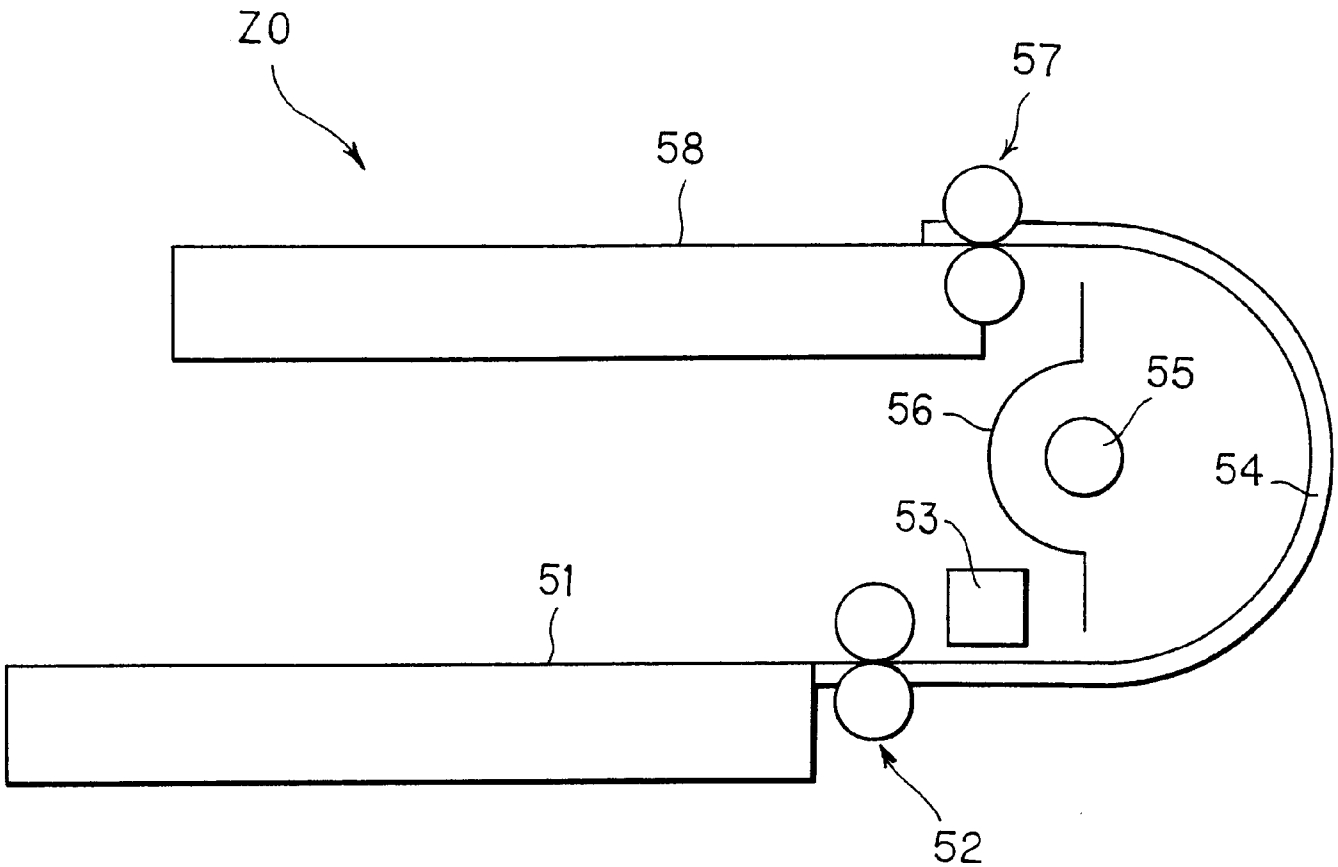
FIG. 1 PRIOR ART
FIG. 1 is a typical view showing the schematic structure of an ink jet printer according to the conventional art.
Figure 2:
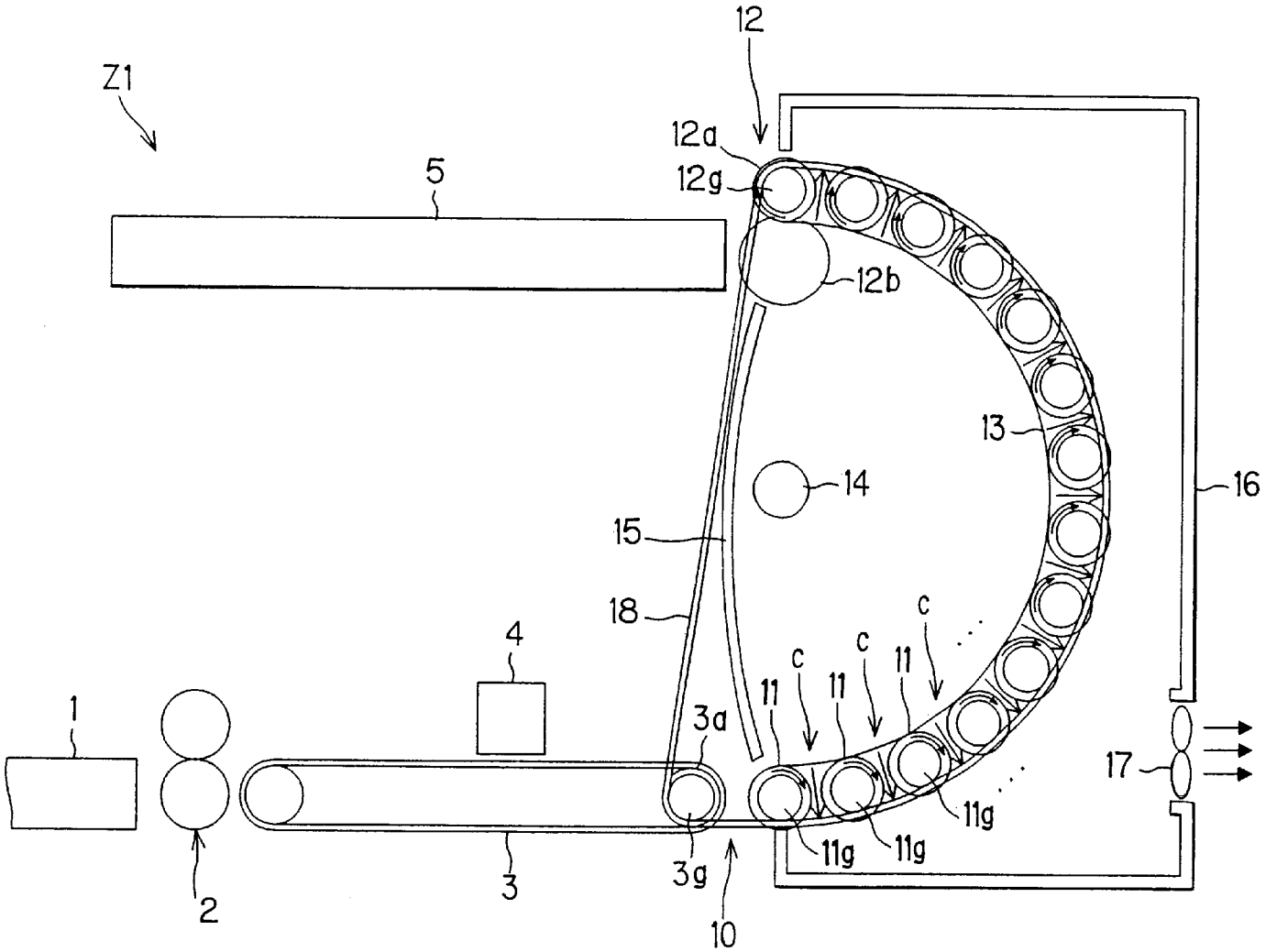
FIG. 2 is a typical view showing the schematic structure of an ink jet printer Z1 according to first embodiment of the present invention.

FIG. 2 is a typical view showing the schematic structure of an ink jet printer Z1 according to the first embodiment of the present invention. The ink jet printer Z1 according to the present embodiment mounts an ink drying portion 10 according to an example of an ink drier in accordance with the present invention.

As shown in FIG. 2, the ink jet printer Z1 comprises a paper tray 1 for storing a print paper, a pinch roller 2 and a conveying belt 3 which serve to convey the paper in the paper tray 1 one by one, an ink jet type print head 4 for forming an image on the paper conveyed through the conveying belt 3, a ink drying portion 10 for drying the paper having an image formed by the print head 4 while inverting the same paper upward, and a discharge tray 5 for accumulating the paper discharged from the ink drying portion 10 (an example of the ink drier).

Furthermore, the ink drying portion 10 is constituted by a plurality of conveying rollers 11, 11, - - - arranged semicylindrically while maintaining a predetermine clearance c (an example of paper conveying means), a curl correcting roller 12 including a rigid roller 12*a* and an elastic roller 12*b* which are provided on the most downstream side of the conveying roller 11 (an example of curl correcting means), an infrared heat source 14 provided in the vicinity of the center of a circular arc of a paper drying passageway 13 formed by the inscribed surfaces of a plurality of conveying rollers 11, 11, - - - arranged semicylindrically, a reflecting plate 15 provided on the back face side of the infrared heat source 14 with respect to the paper drying passageway 13, a housing 16 forming a closed space on the back side-of the conveying rollers 11, 11, - - - (the opposite side of the paper drying passageway 13), and a fan 17 provided on the housing 16 and serving to discharge air in a space in the housing 16. An example of paper holding means is constituted by the housing 16, the fan 17, the clearance c between the conveying rollers and the like.

As described above, the curl correcting means is constituted by the elastic roller 12*b* formed of rubber or the like and the rigid roller 12*a* formed of metal or the like which is less or scarcely deformed elastically. In other words, the curl correcting means has a structure of rollers coming in pressure-contact with each other and is constituted by rollers having different hardnesses. Alternatively, the curl correcting means can be constituted by rollers having an equal hardness and different diameters. For example, the roller 12*b* side is constituted by a roller (elastic roller) having a larger diameter and the roller 12*a* side is constituted by a roller (elastic roller) having a smaller diameter.

Moreover, gears 11*g*, 11*g*, - - - and a gear 12*g* are attached to the conveying rollers 11, 11, - - - and the rigid roller 12*a*, respectively. A toothed endless driving belt 18 is wound upon these gears and a gear 3*g* attached to a driving roller 3*a* of the conveying belt 3. More specifically, the conveying rollers 11, 11, - - - and the rigid roller 12*a* are rotated by the driving force of the driving roller 3*a* which is transmitted to the driving belt 18.

Subsequently, a series of printing procedures for the ink jet printer Z1 will be described.

First of all, one uppermost paper mounted in the paper tray 1 is taken out and is conveyed at a constant speed below the print head 4 through the pinch roller 2 and the conveying belt 3. In that case, the print head 4 forms an image on the paper while carrying out a scan in a direction orthogonal to a paper conveying direction. The paper is sequentially conveyed into the ink drying portion 10 from a portion where an image is formed by the print head 4.

In the ink drying portion 10, the conveying rollers 11 11, - - - and the rigid roller 12*a* are rotated by the driving force of the driving roller 3*a* which is transmitted through the driving belt 18. Moreover, air in the housing 16 is discharged through the fan 17. Consequently, the air is sucked into the housing 16 through the clearances c, c, - - - between the conveying rollers 11, 11 - - - . The paper conveyed into the ink drying portion 10 is continuously conveyed along the paper drying passageway 13 through the conveying rollers 11, 11, - - - while being consecutively held along the paper drying passageway 13 by the air sucking effect of the discharge of the fan 17. At this time, an ink on the paper is dried by direct irradiation with infrared rays from the infrared heat source 14 or by indirect irradiation with infrared rays reflected by the reflecting plate 15.

In the ink drying portion 10, as described above, the paper is continuously held along the paper drying passageway 13 by the air sucking effect through the discharge of the fan 17. Therefore, also in the case in which a paper having a small rigidity such as a thin sheet or a paper in a high humid state is used, the tip of the paper does not droop down by self weight. Consequently, it is possible to reliably prevent the drawback such as a paper jam or an ignition caused by a contact with the heat source 14. Furthermore, the paper is consecutively conveyed along the paper drying passageway 13 through the conveying rollers 11, 11, - - - arranged continuously. Therefore, also in the case in which a paper having a smaller length than a path length of the paper drying passageway 13 is used, for example, it can be conveyed reliably along the paper drying passageway 13.

The paper conveyed by the conveying rollers 11, 11, - - - is inserted into the curl correcting roller 12 provided on the most downstream of the paper drying passageway 13. The curl correcting roller 12 is constituted by causing the rigid roller 12*a* formed of metal or the like and the elastic roller 12*b* formed of rubber or the like to come in close contact with each other. When the paper passes between both rollers, an inward curl generated by passage through the paper drying passageway 13 is corrected.

The paper passing through the curl correcting roller 12 is discharged to the discharge tray 5.

As described above, in the ink jet printer Z1 according to the present embodiment, the paper is consecutively held along the paper drying passageway 13 by the air sucking effect produced by the discharge of the fan 17 in the ink drying portion 10. Therefore, even in the case in which a paper having a small rigidity such as a thin sheet or a paper in a high humid state is used, the tip of the paper does not droop down by the self weight, for example. Thus, it is possible to reliably prevent the drawback such as a paper jam or an ignition caused by a contact with the heat source 14.

Furthermore, the paper is consecutively conveyed along the paper drying passageway 13 through the conveying rollers 11, 11, - - - arranged continuously. Therefore, even in the case in which a paper having a smaller length than a path length of the paper drying passageway 13 is used, for example, the paper can be conveyed reliably along the paper drying passageway 13.

Moreover, the curl correcting roller 12 including the rigid roller 12*a* and the elastic roller 12*b* is provided on the most downstream of the ink drying portion 10. Therefore, it is possible to discharge the paper in such a state that the inward curl generated by the passage through the paper drying passageway 13 is corrected.

The driving rollers 11, 11, - - - and the rigid roller 12*a* can be driven with a very simple structure by using the driving belt 18 described above. It is apparent that various known techniques such as a gear train can also be utilized.

(Variational Example)

Next, a variation of the first embodiment will be described.

Figure 3:
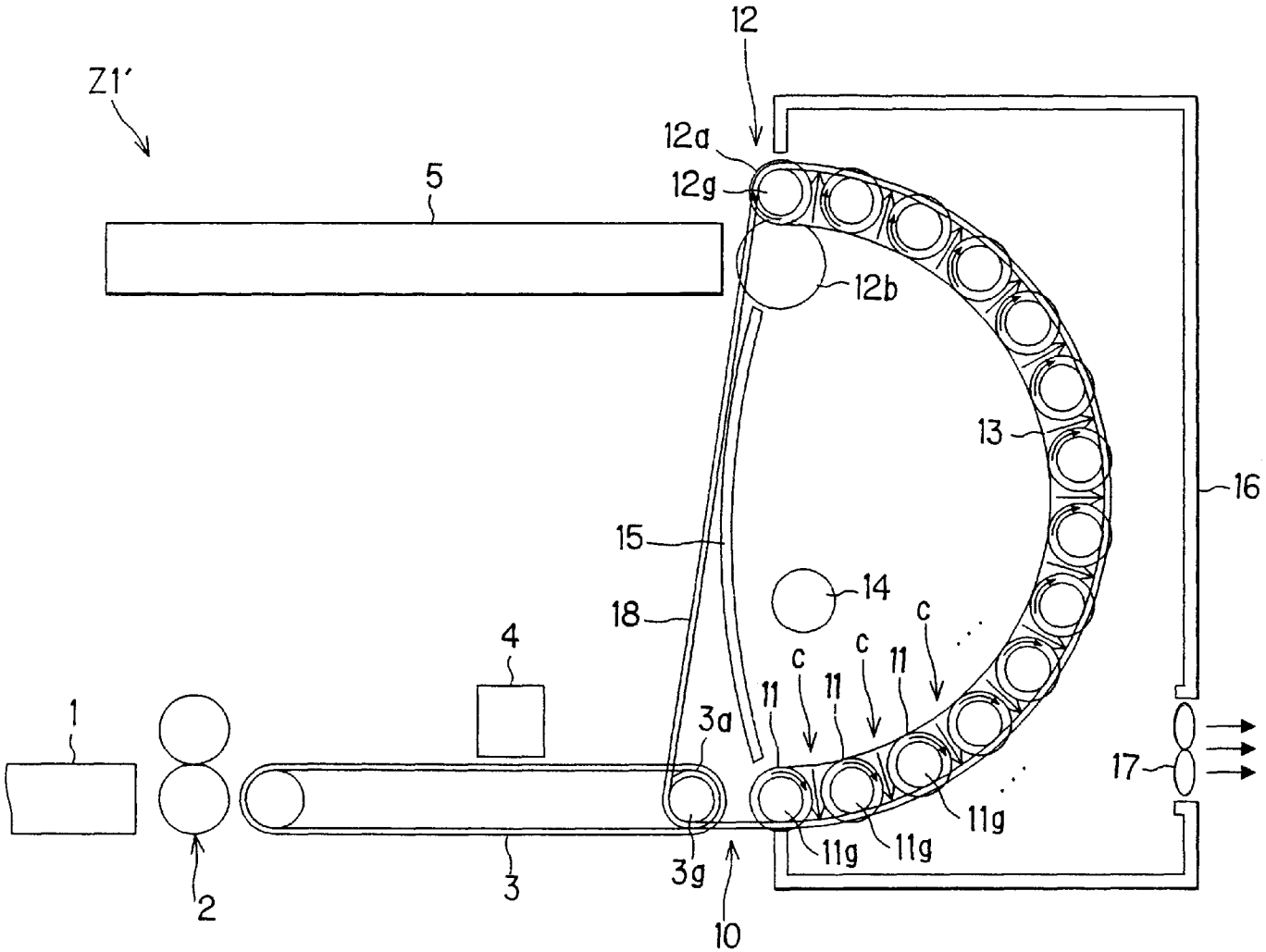
FIG. 3 is a typical view showing the schematic structure of an ink jet printer Z1' according to a variation of the first embodiment of the present invention.

FIG. 3 is a typical view showing an ink jet printer Z1' according to a variation of the first embodiment of the present invention. The structure of the ink jet printer Z1' is almost the same as that of the ink jet printer Z1 and common portions have common designations.

The ink jet printer Z1' is different from the ink jet printer Z1 in that an infrared heat source 14 is placed in a different position and the heat energy of a reflecting plate 15 is reflected in a different direction.

The infrared heat source 14 is provided close to the paper input side (a lower part in the drawing) from the center of a circular arc of the paper drying passageway 13 formed by the inscribed surfaces of a plurality of conveying rollers 11, 11, - - - arranged semicylindrically. The reflecting plate 15 adjusts a reflecting angle thereof or a shape thereof to reflect more heat energy which is not used for paper drying but is dissipated toward the paper input side (the lower part in the drawing) of the paper drying passageway.

With such a structure, the heat energy irradiated on the paper to be conveyed through the paper drying passageway 13 is more increased on the paper input side of the paper drying passageway 13 than the paper output side thereof. More specifically, irradiated heat energy is irradiated with the relationship of the input section of the drying portion 10>the output section of the drying portion 10". A semicircular paper drying path length is determined by a time required for drying the paper. If the drying time is shortened, the drying path length is reduced so that a small-sized structure can be obtained.

Figure 4:
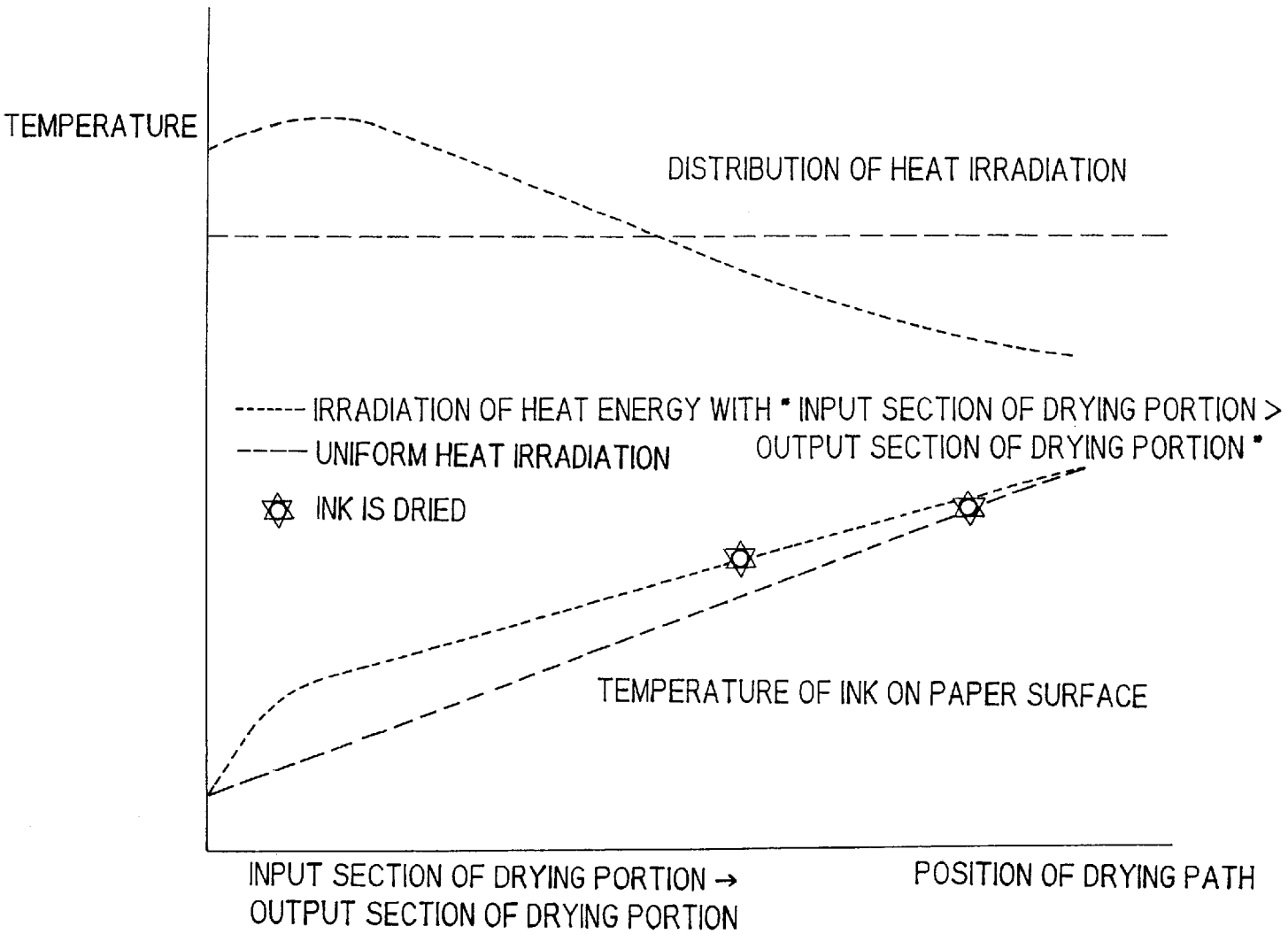
FIG. 4 is a graph showing the relationship between rising ink temperature on a paper surface through infrared irradiation of an infrared heat source and drying time thereof.

FIG. 4 is an experimental graph showing a relationship among irradiated heat energy, an ink temperature on a paper and an ink drying time which is obtained when heat in the paper drying passageway is uniformly irradiated and the heat energy to be irradiated in the present invention is set to "the input section of the drying portion>the output section of the drying portion" in the structures of the infrared heat source 14 and the reflecting plate 15. It is proved that the drying is carried out more quickly as the above relationship of the present invention is maintained. The same effect can be obtained with selection of any one among the position of the infrared heat source 14, or the angle or shape of the reflecting plate 15. <Second Embodiment>

While the example in which the conveying rollers 11, 11, - - - - are used has been described as an example of the paper conveying means in the first embodiment, paper conveying means using a conveying belt can also be proposed, for example.

Figure 5:
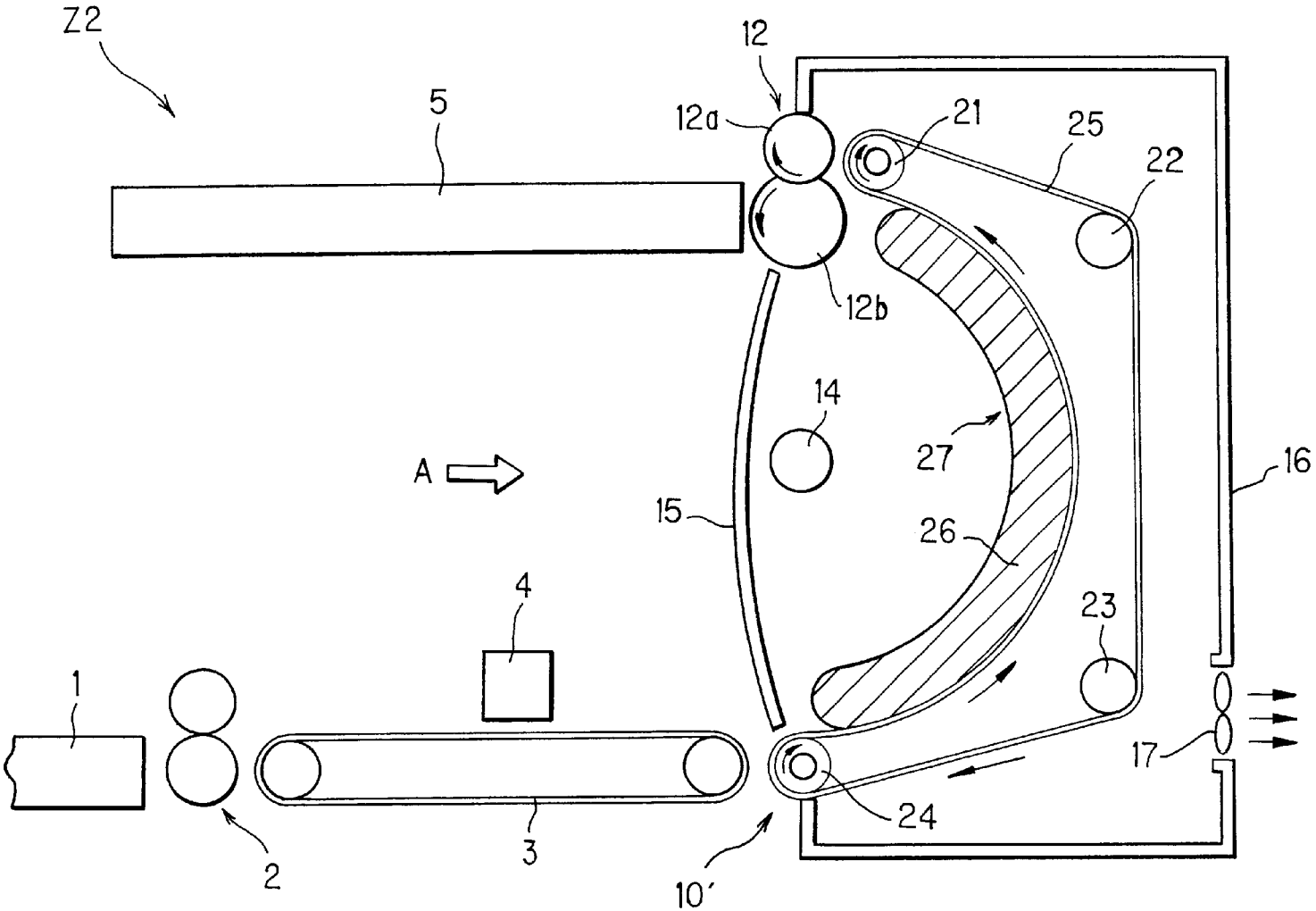
FIG. 5 is a typical view showing the schematic structure of an ink jet printer Z2 according to second embodiment of the present invention.
Figure 6:
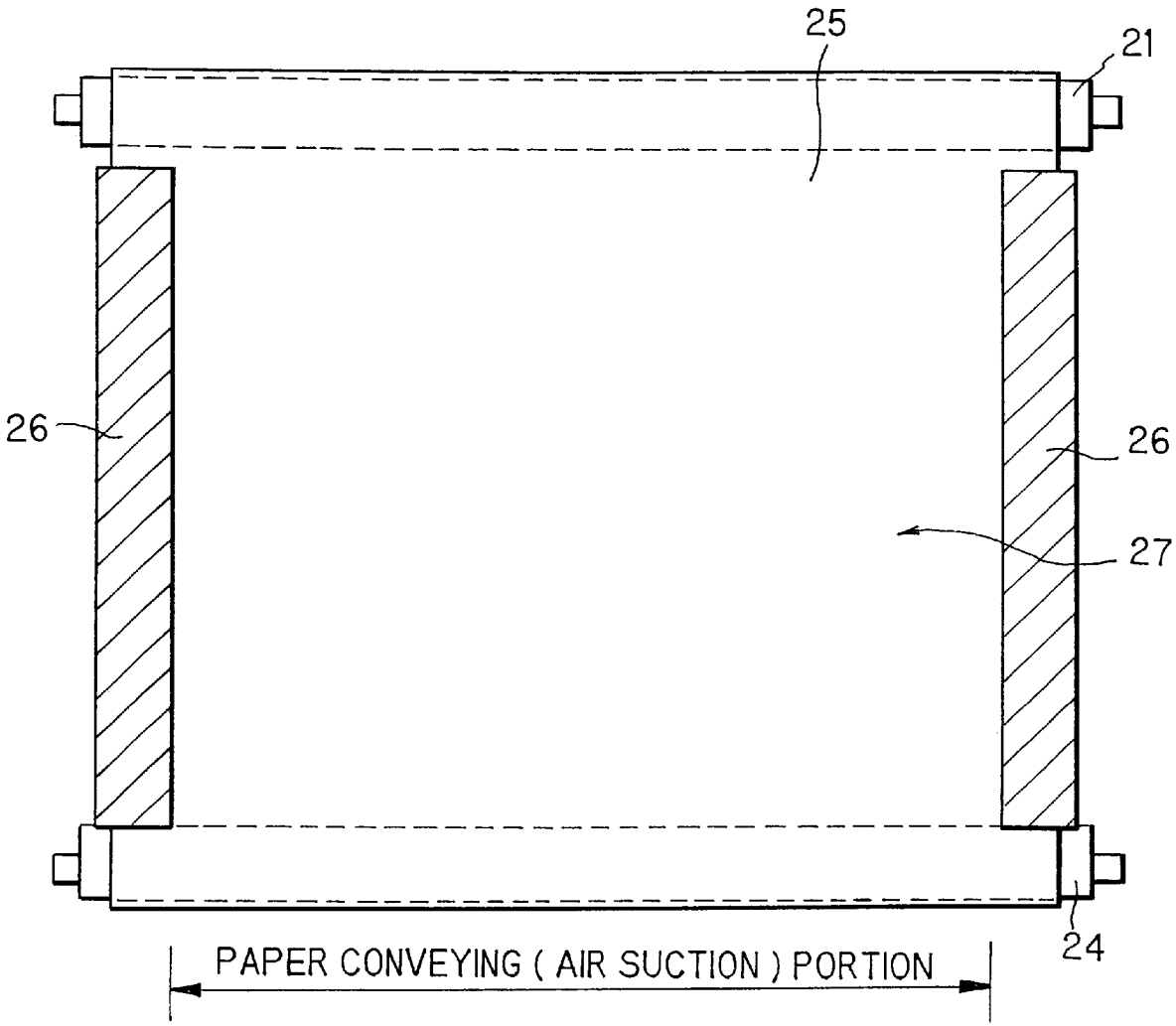
FIG. 6 is. a view showing a paper drying passageway 27 of the ink jet printer Z2 seen in a direction of A in FIG. 5.
Figure 7:
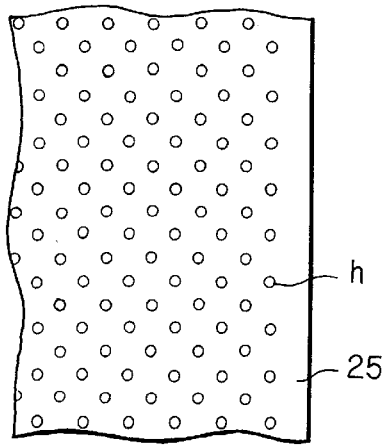
FIG. 7 is a view showing the structure of a conveying belt as paper holding means using air suction.

FIG. 5 is a typical view showing the schematic structure of an ink jet printer Z2 according to a second embodiment of the present invention. As an example of the paper conveying means, a conveying belt is used. FIG. 6 is a view showing a paper drying passageway 27 of the ink jet printer Z2 seen from a direction of A in FIG. 5. FIG. 7 is a view showing the structure of a conveying belt to be paper holding means using air suction.

The ink jet printer Z2 shown in FIG. 5 has the different structure of an ink drying portion 10' from that of the ink jet printer Z1. Referring to other structures, the ink jet printer Z2 is similar to the ink jet printer Z1.

The ink drying portion 10' of the ink jet printer Z2 is guided such that a conveying belt 25 wound onto a driving roller 21 and driven rollers 22, 23 and 24 describes a semicylindrical locus by guide members 26, 26 (see FIG. 6) provided in edge portions on both sides (the outside positions of a paper conveying portion). A paper drying passageway 27 is formed by the portion of the conveying belt 25 which is guided semicylindrically through the guide members 26, 26. Moreover, a small hole h shown in FIG. 7 is regularly formed over most of the whole surface of the conveying belt 25.

Furthermore, the ink jet printer Z2 is the same as the ink jet printer Z1 in that it comprises a curl correcting roller 12 including a rigid roller 12*a* and an elastic roller 12*b* which are provided on the downstream side of the paper drying passageway 27 (an example of curl correcting means), an infrared heat source 14 provided in the vicinity of the center of a circular arc of the paper drying passageway 27, a reflecting plate 15 provided on the back face side of the infrared heat source 14 with respect to the paper drying passageway 27, a housing 16 forming a closed space on the back side of the conveying belt 25 (the opposite side of the guide member 26) and a fan 17 provided on the housing 16 and serving to discharge the space in the housing 16. The housing 16, the fan 17, the hole h of the conveying belt 25 and the like constitute an example of paper holding means.

Subsequently, a series of printing procedures for the ink jet printer Z2 will be described.

First of all, one uppermost paper mounted in the paper tray 1 is taken out and is conveyed at a constant speed below the print head 4 through the pinch roller 2 and the conveying belt 3. In that case, the print head 4 forms an image on the paper while carrying out a scan in a direction orthogonal to a paper conveying direction. The paper is sequentially conveyed into the ink drying portion 10' from a portion where an image is formed by the print head 4. The above-mentioned process is the same as that of the ink jet printer Z1.

In the ink drying portion 10', the conveying belt 25 is rotated in a direction of an arrow by the driving force of the driving roller 21. Moreover, the air in the housing 16 is discharged by the fan 17. Consequently, the air is sucked into the housing 16 through the hole h formed on the conveying belt 25 in the paper drying passageway 27 portion in which the conveying belt 25 is guided semicylindrically through the guide members 26, 26. The paper conveyed into the ink drying portion 10' is continuously conveyed along the paper drying passageway 27 through the movement of the conveying belt 25 while being consecutively held along the paper drying passageway 27 by the air sucking effect of the discharge of the fan 17. At this time, an ink on the paper is dried in a short time by direct irradiation with infrared rays from the infrared heat source 14 or by indirect irradiation with infrared rays reflected by the reflecting plate 15.

The paper conveyed through the conveying belt 25 is inserted into the curl correcting roller 12 provided on the most downstream of the paper drying passageway 27, and an inward curl generated by the passage through the paper drying passageway 27 is corrected and the paper is then discharged onto the discharge tray 5.

As described above, the paper is continuously held along the paper drying passageway 27 by the air sucking effect through the discharge of the fan 17 in the ink drying portion 10' of the ink jet printer Z2. Therefore, also in the case in which a paper having a small rigidity such as a thin sheet or a paper in a high humid state is used, the tip of the paper does not droop down by self weight. Consequently, it is possible to reliably prevent the drawback such as a paper jam or an ignition caused by a contact of the paper with the heat source 14. Furthermore, the paper is consecutively conveyed along the paper drying passageway 27 through the conveying belt 25. Therefore, even in the case in which a paper having a smaller length than a path length of the paper drying passageway 27 is used, for example, it can be conveyed reliably along the paper drying passageway 27.

(First Variation Example)

Figure 8:
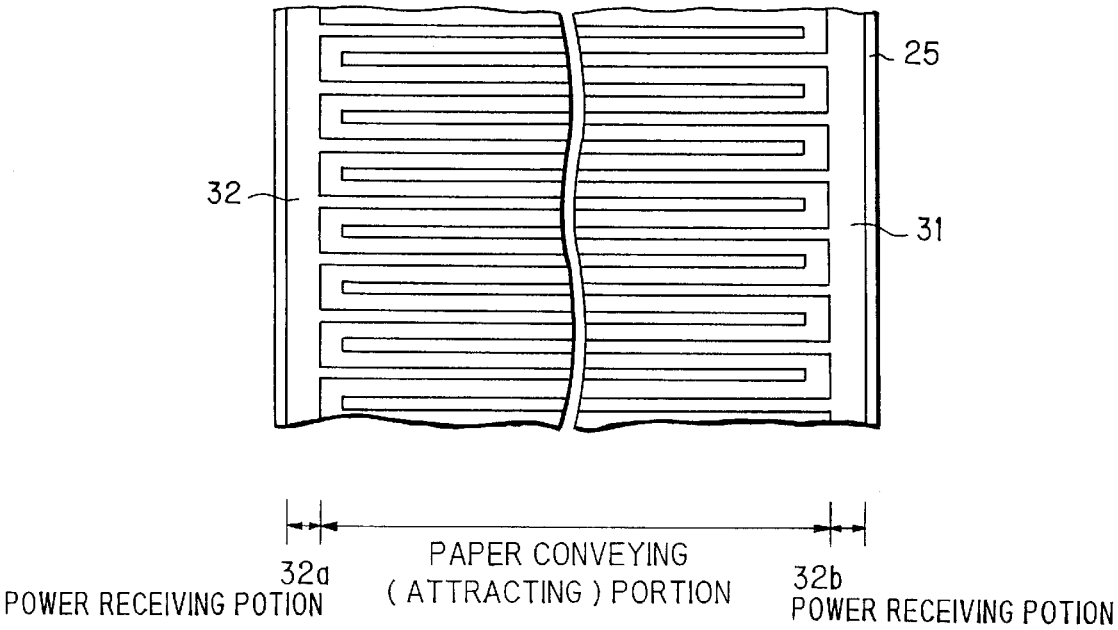
FIG. 8 is a view showing the structure of a conveying belt as paper holding means using electrostatic attraction according to first variation of the second embodiment.
Figure 9:
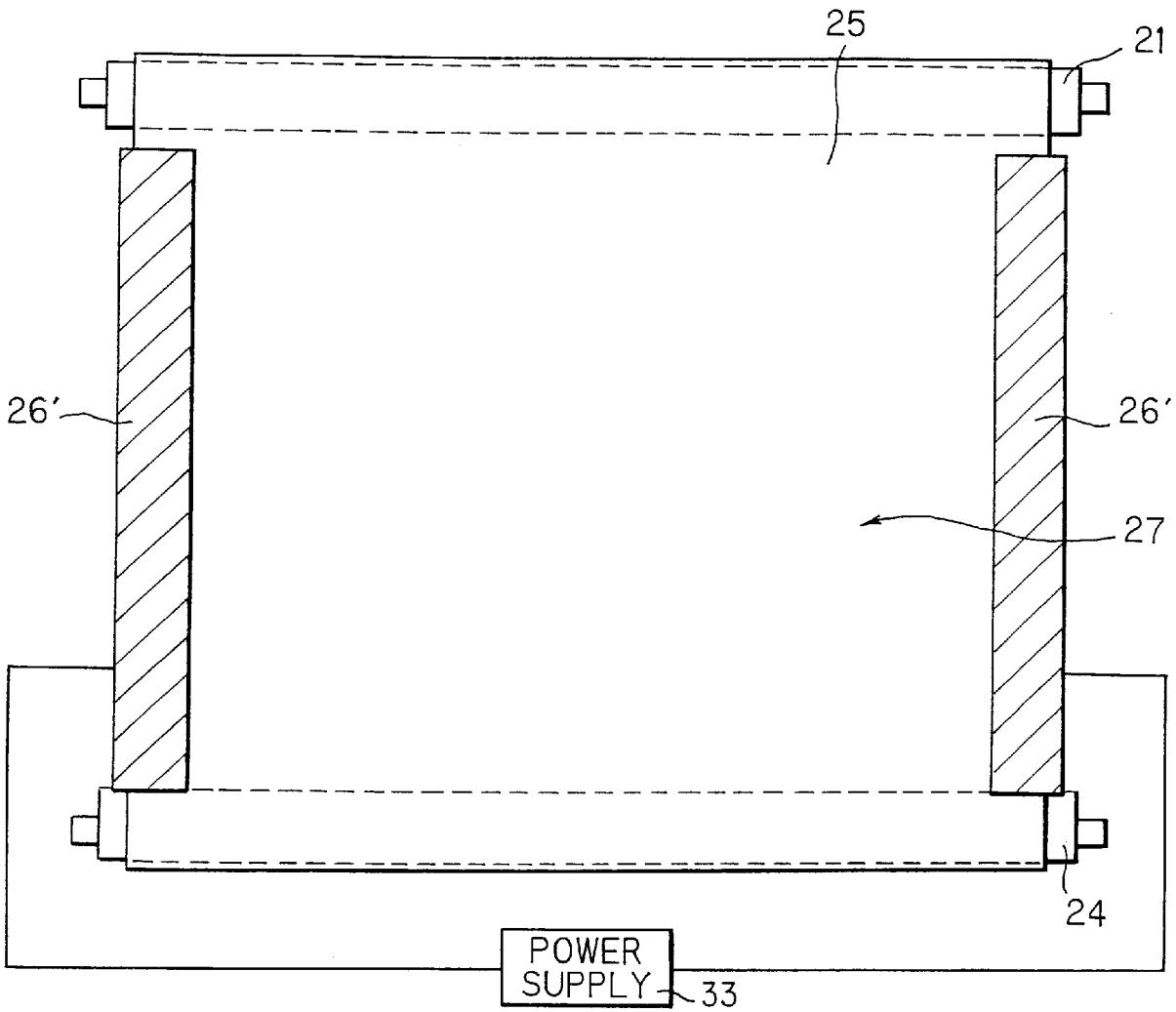
FIG. 9 is a view showing the structure of power supply to electrode of the conveying belt according to the first variation of the second embodiment.

While the ink jet printers Z1 and Z2 using the air suction as an example of the paper holding means have been described above, paper holding means utilizing electrostatic attraction and the like can also be proposed, for example. A first variation in which paper holding means utilizing the electrostatic attraction is used will be described as a variation of the ink jet printer Z2. FIG. 8 is a view showing the structure of a conveying belt to be the paper holding means using the electrostatic attraction according to the first variation of the second embodiment, and FIG. 9 is a view showing the structure of power supply to an electrode of the conveying belt according to the first variation of the second embodiment.

In the ink jet printer Z2 shown in FIG. 5, two electrodes 31 and 32 combined like a comb as shown in FIG. 8 are provided over the whole periphery of the conveying belt 25. The electrodes 31 and 32 can be connected to a power supply 33 through guides 26', 26' as shown in FIG. 9. More specifically, the guides 26', 26' are formed of a conductive fluorine based resin having carbon black mixed therein or the like, for example, to which the power supply 33 is connected. The guides 26', 26' abut on power receiving portions 31*a* and 32*a* of the electrodes 31 and 32, respectively. Consequently, the power can be transmitted to the electrodes 31 and 32 on the rotating conveying belt 25.

With such a structure, the paper conveyed to a paper drying passageway 27 can be attracted into the conveying belt 25 by the electrostatic attracting effect through static electricity stored between the two electrodes 31 and 32 combined like a comb. In the same manner as in the case in which the paper holding means having the air sucking effect described above is used, accordingly, even in the case in which a paper having a small rigidity such as a thin sheet or a paper in a high humid state is used, the tip of the paper does not droop down by self weight so that it is possible to reliably prevent the drawback such as a paper jam or an ignition caused by a contact with a heat source 14.

Meanwhile, in the ink jet printers Z1 and Z1', for example, it is possible to implement the paper holding means using the electrostatic attraction by a method of providing electrodes on the conveying rollers 11, - - - 11, respectively.

(Second Variational Example)

Next, a variation of the second embodiment will be described.

Figure 10:
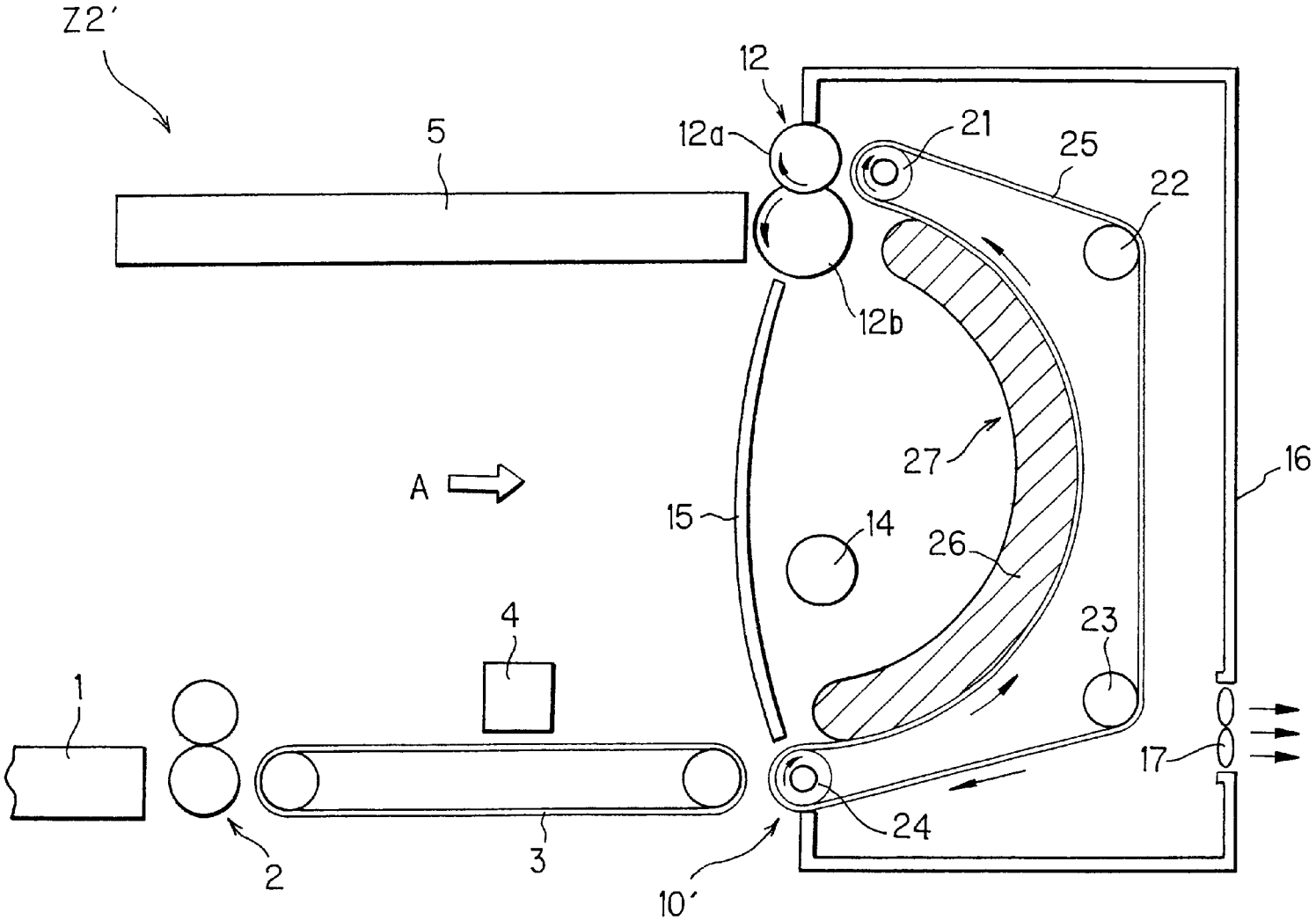
FIG. 10 is a typical view showing the schematic awn structure of an ink jet printer Z2' according to second variation of the second embodiment of the present invention.

FIG. 10 is a typical view showing the schematic structure of an ink jet printer Z2' according to a second variation of the second embodiment of the present invention. The structure of the ink jet printer Z2' is almost the same as that of the ink jet printer Z2 and common portions have common designations.

The ink jet printer Z2' is different from the ink jet printer Z2 in that an infrared heat source 14 is placed in a different position and the heat energy of a reflecting plate 15 is reflected in a different direction.

The infrared heat source 14 is provided close to the paper input side (a lower part) from the center of a circular arc of the paper drying passageway 13 formed by the inscribed surfaces of a plurality of conveying rollers 11, - - - 11, arranged semicylindrically. The reflecting angle or the shape of the reflecting plate 15 are adjusted so as to reflect more heat energy which is not used for paper drying but is dissipated toward the paper input side of the paper drying passageway.

With such a structure, the heat energy irradiated on the paper to be conveyed through the paper drying passageway 13 is more increased on the paper input side of the paper drying passageway 13 than the paper output side thereof. More specifically, the heat energy is irradiated with the relationship of "the input section of the drying portion 10>the output section of the drying portion 10". Thus, a time required for drying can be shortened so that a drying path length can be reduced and a small-sized structure can be obtained.

As described above, the present invention is constituted by an ink drier comprising a semicylindrical paper drying passageway for upward inverting a paper conveyed immediately after printing, a heat source provided on a central side of a circular arc of the paper drying passageway, and paper holding means for continuously holding the paper along the paper drying passageway. Therefore, also in the case in which a paper having a small rigidity such as a thin sheet or a paper in a high humid state is used, for example, the tip of the paper does not droop down by self weight. Thus, it is possible to reliably prevent the drawback such as a paper jam or an ignition caused by a contact with a heat source.

If the paper holding means utilizes the air suction or the electrostatic attraction, for example, the paper can be held reliably with a simple mechanism.

Furthermore, the above-mentioned structure is constituted such that more heat energy sent from the heat source is irradiated onto the paper input side of the paper drying passageway than the paper output side therefore. Consequently, a time required for drying can be shortened so that a paper conveying path length can be reduced and a small-sized structure can be obtained.

Moreover, it is possible to add, to the above-mentioned structure, the paper conveying means for continuously conveying the paper along the semicylindrical paper drying passageway. Consequently, also in the case in which a paper having a smaller length than the path length of the paper drying passageway is used, for example, the paper can be conveyed reliably along the paper drying passageway without a stoppage during the conveying. It may be possible that the paper conveying means may be constituted by a plurality of rollers provided along the paper drying passageway, for example. However, as the paper conveying means is constituted by a belt provided along the paper drying passageway, there are also advantages in that the mechanism can be more simplified, and the air suction, the electrostatic attraction and other paper holding means can also be incorporated as well comparatively easily and the degree of freedom of the paper holding means can be increased.

Furthermore, if the curl correcting means for correcting the curl of the paper is provided on the downstream side of the paper drying passageway, the paper is discharged in such a state that an inward curl generated by the passage through the paper drying passage way is corrected. Therefore, it is possible to obtain more excellent results of printing.

If the curl correcting means is constituted by the rollers having different hardnesses or diameters which come in pressure-contact with each other, reliable correction can be achieved with a simple structure.

If the above-mentioned ink drier is mounted on the ink jet type image forming apparatus, a black solid image formed by a lazy drying black ink or the like can be dried in a short time, for example. Thus, it is possible to increase a speed of printing while maintaining high picture quality. Moreover, the paper is inverted upward and discharged along the semicylindrical paper drying passageway. Therefore, there are also advantages that the size of the device can be reduced and the paper can be stacked up in correct order.

What is claimed is:

1. An ink drier comprising:

a semicylindrical paper drying passageway for upward inverting a paper conveyed immediately after printing;

a heat source provided on a central side of a circular arc of the paper drying passageway; and paper holding means for continuously holding the paper along the paper drying passageway.

2. The ink drier according to claim 1, wherein more heat energy sent from the heat source is irradiated onto a paper input side of the paper drying passageway than a paper output side thereof.

3. The ink drier according to claim 2, wherein the heat source is provided closer to the paper input side than the center of the circular arc of the paper drying passageway.

4. The ink drier according to claim 3, further comprising a reflecting plate provided on a rear face side of the heat source with respect to the paper drying passageway and serving to reflect more heat energy which is not used for paper drying but is dissipated toward the paper input side of the paper drying passageway than the paper output side thereof.

5. The ink drier according to claim 2, further comprising a reflecting plate provided on a rear face side of the heat source with respect to the paper drying passageway and serving to reflect more heat energy which is not used for paper drying but is dissipated toward the paper input side of the paper drying passageway than the paper output side thereof.

6. The ink drier according to claim 1, wherein the paper holding means utilizes air suction.

7. The ink drier according to claim 1, wherein the paper holding means utilizes electrostatic attraction.

8. The ink drier according to claim 1, further comprising paper conveying means for continuously conveying the paper along the paper drying passageway.

9. The ink drier according to claim 8, wherein the paper conveying means is constituted by a plurality of rollers provided along the paper drying passageway.

10. The ink drier according to claim 9, wherein the plurality of rollers are interlocked through one endless belt.

11. The ink drier according to claim 8, wherein the paper conveying means is constituted by a belt provided along the paper drying passageway.

12. The ink drier according to claim 11, wherein the belt as the paper conveying means is guided by a guide member provided along edge portions on both sides of the paper drying passageway.

13. The ink drier according to claim 1, wherein curl correcting means for correcting a curl of the paper is provided on a downstream side of the paper drying passageway.

14. The ink drier according to claim 13, wherein the curl correcting means is constituted by rollers having different hardnesses which come in pressure-contact with each other.

15. The ink drier according to claim 14, wherein the rollers having different hardnesses are constituted by elastic roller and rigid roller.

16. The ink drier according to claim 13, wherein the curl correcting means is constituted by rollers having different diameters which come in pressure-contact with each other.

17. An ink jet type image forming apparatus mounting an ink drier comprising:

a semicylindrical paper drying passageway for upward inverting a paper conveyed immediately after printing;

a heat source provided on a central side of a circular arc of the paper drying passageway; and paper holding means for continuously holding the paper along the paper drying passageway.

* * * * *